US006349285B1

(12) United States Patent
Liu et al.

(10) Patent No.: US 6,349,285 B1
(45) Date of Patent: Feb. 19, 2002

(54) AUDIO BASS MANAGEMENT METHODS AND CIRCUITS AND SYSTEMS USING THE SAME

(75) Inventors: Pu Liu; Raghunath Rao; Miroslav Dokic, all of Austin, TX (US)

(73) Assignee: Cirrus Logic, Inc.

( * ) Notice: Subject to any disclaimer, the term of this patent is extended or adjusted under 35 U.S.C. 154(b) by 0 days.

(21) Appl. No.: 09/340,619

(22) Filed: Jun. 28, 1999

(51) Int. Cl.[7] ..... G10L 21/00
(52) U.S. Cl. ..... 704/500; 704/504
(58) Field of Search ..... 704/500, 504, 704/501, 200, 201, 226, 227, 228; 381/300, 27, 5, 307, 18; 360/32, 61, 15

(56) References Cited

U.S. PATENT DOCUMENTS

| | | | | |
|---|---|---|---|---|
| 4,802,119 A | | 1/1989 | Heene et al. | |
| 4,991,217 A | | 2/1991 | Garrett et al. | |
| 5,193,204 A | | 3/1993 | Qureshi | |
| 5,206,884 A | | 4/1993 | Bhaskar | |
| 5,222,081 A | | 6/1993 | Lewis et al. | |
| 5,235,671 A | | 8/1993 | Mazor | |
| 5,374,916 A | | 12/1994 | Chu | |
| 5,436,900 A | | 7/1995 | Hammar et al. | |
| 5,467,087 A | | 11/1995 | Chu | |
| 5,491,771 A | | 2/1996 | Gupta, et al. | |
| 5,497,373 A | | 3/1996 | Hulen et al. | |
| 5,553,063 A | | 9/1996 | Dickson | |
| 5,553,271 A | | 9/1996 | Hile et al. | |
| 5,594,560 A | | 1/1997 | Sung et al. | |
| 5,652,903 A | | 7/1997 | Weng et al. | |
| 5,761,516 A | | 6/1998 | Rostoker et al. | |
| 5,768,613 A | | 6/1998 | Askghar | |
| 5,784,544 A | | 7/1998 | Stevens | |
| 5,832,120 A | | 11/1998 | Prabhakar et al. | |
| 5,835,375 A | | 11/1998 | Kitamura | |
| 6,081,783 A | * | 6/2000 | Divine et al. | 704/500 |
| 6,108,430 A | * | 8/2000 | Kurisu | 381/310 |
| 6,181,796 B1 | * | 1/2001 | Johnson | 381/28 |
| 6,205,223 B1 | * | 3/2001 | Rao et al. | 380/42 |
| 6,240,189 B1 | * | 5/2001 | Aylward | 381/18 |

FOREIGN PATENT DOCUMENTS

| | | |
|---|---|---|
| EP | 0 514 949 A2 | 11/1992 |
| EP | 0 682 337 A1 | 11/1995 |
| EP | 0 734 021 A2 | 9/1996 |

* cited by examiner

*Primary Examiner*—Richemond Dorvil
(74) *Attorney, Agent, or Firm*—James J. Murphy; Winstead Sechrest & Minick

(57) ABSTRACT

A method of managing multiple channels of audio data in an audio system having multiple speakers. A first channel signal is selectively passed through a software high-pass filter to selectively drive a first one of the speakers. A plurality of channel signals are selectively summed in software to generate a composite signal and the composite signal passed through a software low-pass filter to selectively drive a second one of the speakers.

23 Claims, 6 Drawing Sheets

AUDIO BASS MANAGEMENT METHODS AND CIRCUITS AND SYSTEMS USING THE SAME

CROSS-REFERENCE TO RELATED APPLICATION

The following co-pending and co-assigned application contains related information and is hereby incorporated by reference: Ser. No. 08/970,979, entitled "DIGITAL AUDIO DECODING CIRCUITRY, METHODS AND SYSTEMS", filed Nov. 14, 1997; and Ser. No. 09/042,288, entitled "INPUT DATA FORMAT AUTODETECTION SYSTEMS AND METHODS", filed Mar. 13, 1998.

BACKGROUND OF THE INVENTION

1. Field of the Invention

The present invention relates in general to data processing and in particular, to audio bass management and methods and circuits and systems using the same.

2. Description of the Related Art

The ability to process audio information has become increasingly important in the personal computer (PC) environment. Among other things, audio is important in many multimedia applications, such as gaming and telecommunications. Audio functionality is therefore typically available on most conventional PCs, either in the form of an add-on audio board or as a standard feature provided on the motherboard itself. In fact, PC users increasingly expect not only audio functionality but high quality sound capability. Additionally, digital audio plays a significant role outside the traditional PC realm, such as in compact disk players, VCRs and televisions. As the audio technology progresses, digital applications are increasingly sophisticated as improvements in sound quality and sound effects are sought.

One of the key components in many digital audio information processing systems is the decoder. Generally, the decoder receives data in a compressed form and converts that data into a decompressed digital form. The decompressed digital data is then passed on for further processing, such as filtering, expansion or mixing, conversion into analog form, and eventually conversion into audible tones. In other words the decoder must provide the proper hardware and software interfaces to communicate with the possible compressed (and decompressed) data sources, as well as the destination digital and/or audio devices. In addition, the decoder must have the proper interfaces required for overall control and debugging by a host microprocessor or microcontroller. Further, the decoder must also perform additional functions appropriate to the decoder subsystem of a digital audio system, such as the mixing of various received digital and/or audio data streams.

During processing of streaming data, such as audio data (compressed or decompressed), it is essential that the processing device or system be capable of throughputting data accurately and with the requisite speed. One way of insuring this is by providing efficient communications between the various processing blocks within the given system or device. This is especially true when multiple processors are utilized. Thus, the need has arisen for circuits and methods of maintaining efficient communication between processing blocks, for use in such applications as advanced audio decoders.

In addition, advanced audio decoders should also be capable of performing post processing functions on the multichannel audio. These could include tasks such as bass management to accommodate the program content to the particular setup, tone control, graphic or parametric equalization, etc.

SUMMARY OF THE INVENTION

Disclosed is a method of managing the bass in multiple channels of audio data in an audio system having multiple speakers of different bass capabilities. A first channel signal is selectively passed through a software high-pass filter to selectively drive a first one of the speakers. A plurality of channel signals are selectively summed in software to generate a composite signal and a composite signal is selectively passed through a software low-pass filter to selectively drive a second one of the speakers.

The principles of the present invention provide numerous advantages over the prior art. Among other things, bass management can be fully implemented on a single chip audio processing device instead of an entire circuit board of analog components. Additionally, a significant number of possible speaker and filter configurations, both standard and custom, can be supported by the hardware and software described herein.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

The principles of the present invention and their advantages are best understood by referring to the illustrated embodiment depicted in FIGS. 1–8 of the drawings, in which like numbers designate like parts.

Figure 1A:
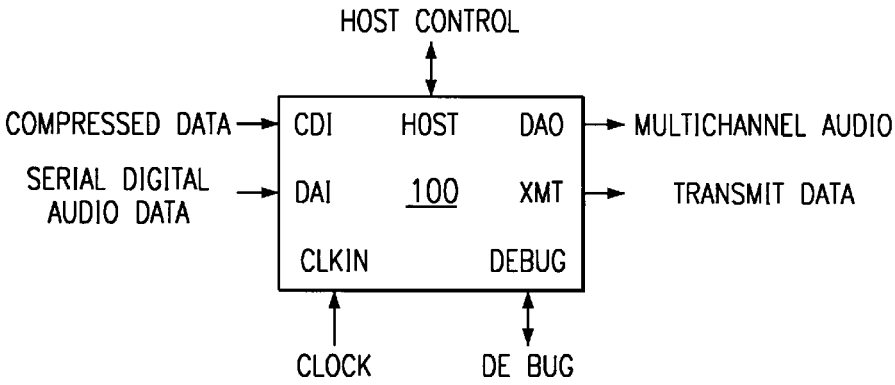
FIG. 1A is a diagram of a multichannel audio decoder embodying the principles of the present invention.

FIG. 1A is a general overview of an audio information decoder 100 embodying the principles of the present invention. Decoder 100 is operable to receive data in any one of a number of formats, including compressed data in conforming to the AC-3 digital audio compression standard, (as defined by the United States Advanced Television System Committee) through a compressed data input port CDI. An independent digital audio data (DAI) port provides for the input of PCM, S/PDIF, or non-compressed digital audio data.

A digital audio output (DAO) port provides for the output of multiple-channel decompressed digital audio data. Independently, decoder 100 can transmit data in the S/PDIF (Sony-Phillips Digital Interface) format through a transmit port XMT.

Decoder 100 operates under the control of a host microprocessor through a host port HOST and supports debugging by an external debugging system through the debug port DEBUG. The CLK port supports the input of a master clock for generation of the timing signals within decoder 100.

While decoder 100 can be used to decompress other types of compressed digital data, it is particularly advantageous to use decoder 100 for decompression of AC-3 bits streams.

Figure 1B:
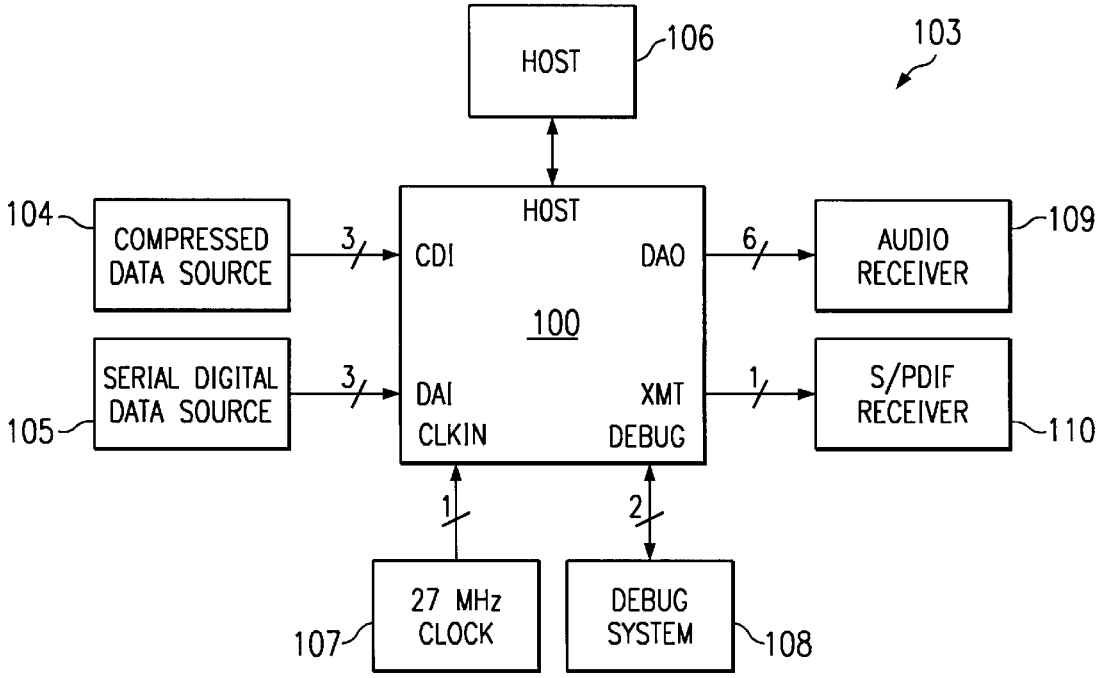
FIG. 1B is a diagram showing the decoder of FIG. 1 in an exemplary system context.

FIG. 1B shows decoder 100 embodied in a representative system 103. Decoder 100 as shown includes three compressed data input (CDI) pins for receiving compressed data from a compressed audio data source 104 and an additional three digital audio input (DAI) pins for receiving serial digital audio data from a digital audio source 105. Examples of compressed serial digital audio source 105, and in particular of AC-3 compressed digital sources, are digital video discs and laser disc players.

Host port (HOST) allows coupling to a host processor 106, which is generally a microcontroller or microprocessor that maintains control over the audio system 103. For instance, in one embodiment, host processor 106 is the microprocessor in a personal computer (PC) and System 103 is a PC-based sound system. In another embodiment, host processor 106 is a microcontroller in an audio receiver or controller unit and system 103 is a non-PC-based entertainment system such as conventional home entertainment systems produced by Sony, Pioneer, and others. A master clock, shown here, is generated externally by clock source 107. The debug port (DEBUG) consists of two lines for connection with an external debugger, which is typically a PC-based device.

Decoder 100 has six output lines for outputting multichannel audio digital data (DAO) to digital audio receiver 109 in any one of a number of formats including 3-lines out, 2/2/2, 4/2/0, 4/0/2 and 6/0/0. A transmit port (XMT) allows for the transmission of S/PDIF data to an S/PDIF receiver 110. These outputs may be coupled, for example, to digital to analog converters or codecs for transmission to analog receiver circuitry.

Figure 1C:
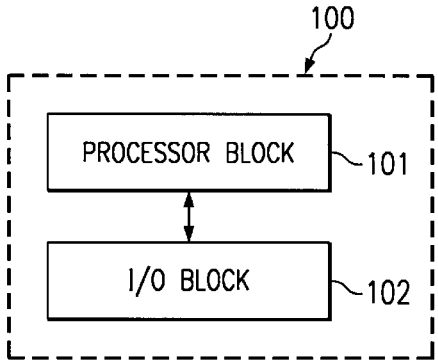
FIG. 1C is a diagram showing the partitioning of the decoder into a processor block and an input/output (I/O) block.

FIG. 1C is a high level functional block diagram of a multichannel audio decoder 100 embodying the principles of the present invention. Decoder 100 is divided into two major sections, a Processor Block 101 and the I/O Block 102. Processor Block 106 includes two digital signal processor (DSP) cores, DSP memory, and system reset control. I/O Block 102 includes interprocessor communication registers, peripheral I/O units with their necessary support logic, and interrupt controls. Blocks 101 and 102 communicate via interconnection with the I/O buses of the respective DSP cores. For instance, I/O Block 102 can generate interrupt requests and flag information for communication with Processor Block 101. All peripheral control and status registers are mapped to the DSP I/O buses for configuration by the DSPs.

Figure 2:
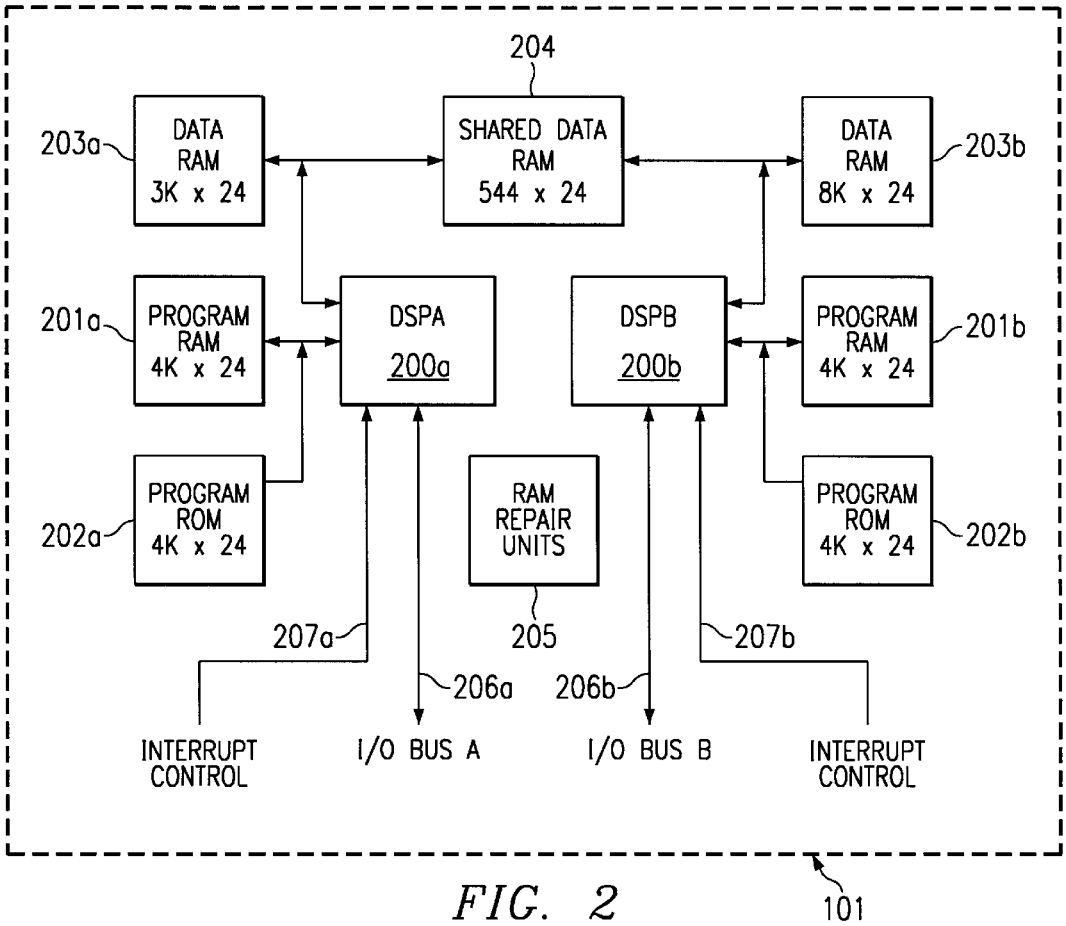
FIG. 2 is a diagram of the processor block of FIG. 1C.

FIG. 2 is a detailed functional block diagram of processor block 101. Processor block 101 includes two DSP cores 200*a* and 200*b*, labeled DSPA and DSPB respectively. Cores 200*a* and 200*b* operate in conjunction with respective dedicated program RAM 201*a* and 201*b*, program ROM 202*a* and 202*b*, and data RAM 203*a* and 203*b*. Shared data RAM 204, which the DSPs 200*a* and 200*b* can both access, provides for the exchange of data, such as PCM data and processing coefficients, between processors 200*a* and 200*b*. Processor block 101 also contains a RAM repair unit 205 that can repair a predetermined number of RAM locations within the on-chip RAM arrays to increase die yield.

DSP cores 200*a* and 200*b* respectively communicate with the peripherals through I/O Block 102 via their respective I/O buses 206*a*, 206*b*. The peripherals send interrupt and flag information back to the processor block via interrupt interfaces 207*a*, 207*b*.

Figure 3:
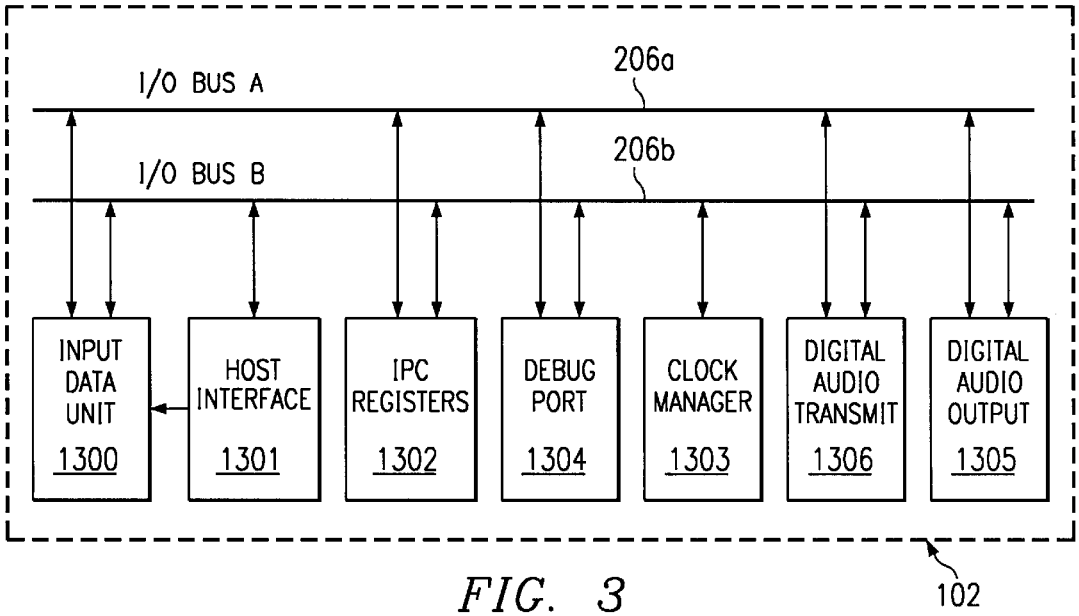
FIG. 3 is a diagram of the primary functional subblock of the I/O block of FIG. 1C.

FIG. 3 is a detailed functional block diagram of I/O block 102. Generally, I/O block 102 contains peripherals for data input, data output, communications, and control. Input Data Unit 1200 accepts either compressed analog data or digital audio in any one of several input formats (from either the CDI or DAI ports). Serial/parallel host interface 1301 allows an external controller to communicate with decoder 100 through the HOST port. Data received at the host interface port 1301 can also be routed to input data unit 1300.

IPC (Inter-processor Communication) registers 1302 support a control-messaging protocol for communication between processing cores 200 over a relatively low-bandwidth communication channel. High-bandwidth data can be passed between cores 200 via shared memory 204 in processor block 101.

Clock manager 1303 is a programmable PLL/clock synthesizer that generates common audio clock rates from any selected one of a number of common input clock rates through the CLKIN port. Clock manager 1303 includes an STC counter which generates time stamp information used by processor block 101 for managing playback and synchronization tasks. Clock manager 1303 also includes a programmable timer to generate periodic interrupts to processor block 101.

Debug circuitry 1304 is provided to assist in applications development and system debug using an external DEBUGGER and the DEBUG port, as well as providing a mechanism to monitor system functions during device operation.

A Digital Audio Output port 1305 provides multichannel digital audio output in selected standard digital audio formats. A Digital Audio Transmitter 1306 provides digital audio output in formats compatible with S/PDIF or AES/EBU.

In general, I/O registers are visible on both I/O buses, allowing access by either DSPA (200*a*) or DSPB (200*b*). Any read or write conflicts are resolved by treating DSPB as the master and ignoring DSPA.

The principles of the present invention further allow for methods of decoding compressed audio data, as well as for methods and software for operating decoder 100. These principles will be discussed in further detail below. Initially, a brief discussion of the theory of operation of decoder 100 will be undertaken.

The Host can choose between serial and parallel boot modes during the reset sequence. The Host interface mode and autobit mode status bits, available to DSPB 200*b* in the HOSTCTL register MODE field, control the boot mode selection. Since the host or an external host ROM always communicates through DSPB. DSPA 200*a* and 200*b* receives code from DSPB 200*b* in the same fashion, regardless of the host mode selected.

In a dual-processor environment like decoder 100, it is important to partition the software application optimally between the two processors 200*a*, 200*b* to maximize processor usage and minimize inter-processor communication. For this the dependencies and scheduling of the tasks of each processor must be analyzed. The algorithm must be partitioned such that one processor does not unduly wait for the other and later be forced to catch up with pending tasks. For example, in most audio decompression tasks including Dolby AC-3, the algorithm being executed consists of 2 major stages: 1) parsing the input bitstream with specified/computed bit allocation and generating frequency-domain transform coefficients for each channel; and 2) performing the inverse transform to generate time-domain PCM samples for each channel. Based on this and the hardware resources available in each processor, and accounting for other housekeeping tasks the algorithm can be suitably partitioned.

Usually, the software application will explicitly specify the desired output precision, dynamic range and distortion requirements. Apart from the intrinsic limitation of the compression algorithm itself, in an audio decompression task the inverse transform (reconstruction filter bank) is the stage which determines the precision of the output. Due to the finite-length of the registers in the DSP, each stage of processing (multiply+accumulate) will introduce noise due to elimination of the lesser significant bits. Adding features such as rounding and wider intermediate storage registers can alleviate the situation.

For example, Dolby AC-3 requires 20-bit resolution PCM output which corresponds to 120 dB of dynamic range. The decoder uses a 24-bit DSP which incorporates rounding, saturation and 48-bit accumulators in order to achieve the desired 20-bit precision. In addition, analog performance should at least preserve 95 dB S/N and have a frequency response of +/−0.5 dB from 3 Hz to 20 kHz.

Based on application and design requirements, a complex real-time system, such as audio decoder 100, is usually partitioned into hardware, firmware and software. The hardware functionality described above is implemented such that it can be programmed by software to implement different applications. The firmware is the fixed portion of software portion including the boot loader, other fixed function code and ROM tables. Since such a system can be programmed, it is advantageously flexible and has less hardware risk due to simpler hardware demands.

There are several benefits to the dual core (DSP) approach according to the principles of the present invention. DSP cores 200A and 200B can work in parallel, executing different portions of an algorithm and increasing the available processing bandwidth by almost 100%. Efficiency improvement depends on the application itself. The important thing in the software management is correct scheduling, so that the DSP engines 200A and 200B are not waiting for each other. The best utilization of all system resources can be achieved if the application is of such a nature that can be distributed to execute in parallel on two engines. Fortunately, most of the audio compression algorithms fall into this category, since they involve a transform coding followed by fairly complex bit allocation routine at the encoder. On the decoder side the inverse is done. Firstly, the bit allocation is recovered and the inverse transform is performed. This naturally leads into a very nice split of the decompression algorithm. The first DSP core (DSPA) works on parsing the input bitstream, recovering all data fields, computing bit allocation and passing the frequency domain transform coefficients to the second DSP (DSPB), which completes the task by performing the inverse transform (IFFT or IDCT depending on the algorithm). While the second DSP is finishing the transform for a channel n, the first DSP is working on the channel n+1, making the processing parallel and pipelined. The tasks are overlapping in time and as long as tasks are of the same complexity, there will be no waiting on either DSP side.

Figure 4:
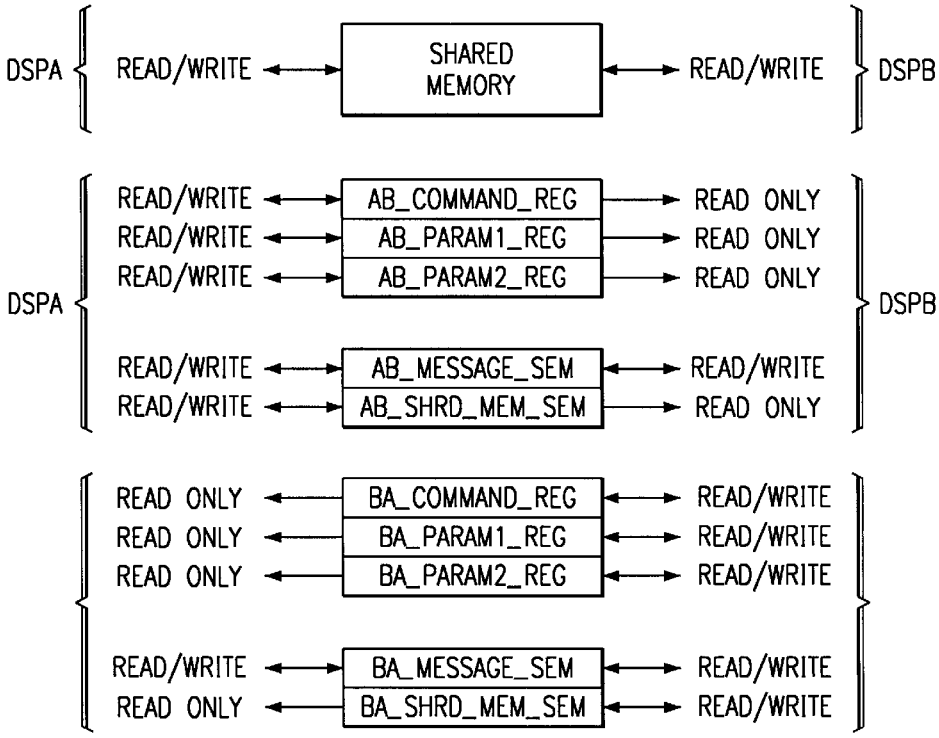
FIG. 4 is a diagram of the interprocessor communications (IPC) registers as shown in FIG. 3.

Decoder 100, as discussed above, includes shared memory of 544 words as well as communication "mailbox" (IPC block 1302) consisting of 10 I/O registers (5 for each direction of communication). FIG. 4 is a diagram representing the shared memory space and IPC registers (1302).

One set of communication registers looks like this (a) AB_command_register (DSPA write/read, DSPB read only)

(b) AB_parameter1_register (DSPA write/read, DSPB read only)

(c) AB_parameter2_register (DSPA write/read, DSPB read only)

(d) AB_message_semaphores (DSPA write/read, DSPB write/read as well)

(e) AB_shared_memory_semaphores (DSPA write/read, DSPB read only) where AB denotes the registers for communication from DSPA to DSPB. Similarly, the BA set of registers are used in the same manner, with simply DSPB being primarily the controlling processor.

Shared memory 204 is used as a high throughput channel, while communication registers serve as low bandwidth channel, as well as semaphore variables for protecting the shared resources.

Both DSPA and DSPA 200*a*, 200*b* can write to or read from shared memory 204. However, software management provides that the two DSPs never write to or read from shared memory in the same clock cycle. It is possible, however, that one DSP writes and the other reads from shared memory at the same time, given a two-phase clock in the DSP core. This way several virtual channels of communications could be created through shared memory. For example, one virtual channel is transfer of frequency domain coefficients of AC-3 stream and another virtual channel is transfer of PCM data independently of AC-3. While DSPA is putting the PCM data into shared memory, DSPB might be reading the AC-3 data at the same time. In this case both virtual channels have their own semaphore variables which reside in the AB_shared_memory_semaphores registers and also different physical portions of shared memory are dedicated to the two data channels. AB_command_register is connected to the interrupt logic so that any write access to that register by DSPA results in an interrupt being generated on the DSPB, if enabled. In general, I/O registers are designed to be written by one DSP and read by another. The only exception is AB_message_sempahore register which can be written by both DSPs. Full symmetry in communication is provided even though for most applications the data flow is from DSPA to DSPB. However, messages usually flow in either direction, another set of 5 registers are provided as shown in FIG. 4 with BA prefix, for communication from DSPB to DSPA.

The AB_message_sempahore register is very important since it synchronizes the message communication. For example, if DSPA wants to send the message to DSPB, first it must check that the mailbox is empty, meaning that the previous message was taken, by reading a bit from this register which controls the access to the mailbox. If the bit is cleared, DSPA can proceed with writing the message and setting this bit to 1, indicating a new state, transmit mailbox full. The DSPB may either poll this bit or receive an interrupt (if enabled on the DSPB side), to find out that new message has arrived. Once it processes the new message, it clears the flag in the register, indicating to DSPA that its transmit mailbox has been emptied. If DSPA had another message to send before the mailbox was cleared it would have put in the transmit queue, whose depth depends on how much message traffic exists in the system. During this time DSPA would be reading the mailbox full flag. After DSPB has cleared the flag (set it to zero), DSPA can proceed with the next message, and after putting the message in the mailbox it will set the flag to I. Obviously, in this case both DSPs have to have both write and read access to the same physical register. However, they will never write at the same time, since DSPA is reading flag until it is zero and setting it to 1, while DSPB is reading the flag (if in polling mode) until it is 1 and writing a zero into it. These two processes a staggered in time through software discipline and management.

When it comes to shared memory a similar concept is adopted. Here the AB_shared_memory_semaphore register is used. Once DSPA computes the transform coefficients but before it puts them into shared memory, it must check that the previous set of coefficients, for the previous channel has been taken by the DSPB. While DSPA is polling the semaphore bit which is in AB_shared_memory_semaphore register it may receive a message from DSPB, via interrupt, that the coefficients are taken. In this case DSPA resets the semaphore bit in the register in its interrupt handler. This way DSPA has an exclusive write access to the AB_shared_memory_semaphore register, while DSPB can only read from it. In case of AC-3, DSPB is polling for the availability of data in shared memory in its main loop, because the dynamics of the decode process is data driven. In other words there is no need to interrupt DSPB with the message that the data is ready, since at that point DSPB may not be able to take it anyway, since it is busy finishing the previous channel. Once DSPB is ready to take the next channel it will ask for it. Basically, data cannot be pushed to DSPB, it must be pulled from the shared memory by DSPB.

The exclusive write access to the AB_shared_memory_semaphore register by DSPA is all that more important if there is another virtual channel (PCM data) implemented. In this case, DSPA might be putting the PCM data into shared memory while DSPB is taking AC-3 data from it. So, if DSPB was to set the flag to zero, for the AC-3 channel, and DSPA was to set PCM flag to 1 there would be an access collision and system failure will result. For this reason, DSPB is simply sending message that it took the data from shared memory and DSPA is setting shared memory flags to zero in its interrupt handler. This way full synchronization is achieved and no access violations performed.

When designing a real time embedded system both hardware and software designers are faced with several important trade-off decisions. For a given application a careful balance must be obtained between memory utilization and the usage of available processing bandwidth. For most applications there exist a very strong relationship between the two: memory can be saved by using more MIPS or MIPS could be saved by using more memory. Obviously, the trade-off exists within certain boundaries, where a minimum amount of memory is mandatory and a minimum amount of processing bandwidth is mandatory.

The proper input FIFO is important not only for the correct operation of the DSP chip itself, but it can simplify the overall system in which decoder 100 reside. For example, in a set-top box, where AC-3 audio is multiplexed in the MPEG2 transport stream, the minimum buffering requirement (per the MPEG spec) is 4 kbytes. Given the 8 byte input FIFO in decoder 100 (divisible arbitrarily in two, with minimum resolution of 512 bytes), any audio bursts from the correctly multiplexed MPEG2 transport stream can be accepted, meaning that no extra buffering is required upstream in the associated demux chip. In other words, demux will simply pass any audio data directly to the codec 100, regardless of the transport bit rate, thereby reducing overall system cost.

Also, a significant amount of MIPS can be saved in the output FIFOs, which act as a DMA engine, feeding data to the external DACs. In case there are no output FIFOs the DSP has to be interrupted at the Fs rate (sampling frequency rate). Every interrupt has some amount of overhead associated with switching the context, setting up the pointers, etc. In the case of the codec 100, a 32 sample output is provided FIFO with half-empty interrupt signal to the DSP, moaning that the DSP is now interrupted at Fs/16 rate. Subsequently, any interrupt overhead is reduced by a factor of 16 as well, which can result in 2–3 MIPS of savings.

In the dual DSP architecture of decoder 100 the amount of shared memory is critical. Since this memory is essentially dual ported resulting in much larger memory cells and occupying much more die area, it is very critical to size it properly. Since decoder 100 has two input data ports, and the input FIFO is divisible to receive data simultaneously from the two ports, the shared memory was also designed to handle two data channels. Since the size of one channel of one block of AC-3 data is 256 transform coefficients a 256 element array has been allocated. That is, 256 PCM samples can be transferred at the same time while transferring AC-3 transform coefficients. However, to keep two DSP cores 200*a* and 200*b* in sync and in the same context, an additional 32 memory locations are provided to send a context descriptor with each channel from DSPA to DSPB. This results in the total shared memory size of 544 elements, which is sufficient not only for AC-3 decompression implementation but also for MPEG 5.1 channel decompression as well as DTS audio decompression.

In multichannel audio systems such as that described above, the end user may select between various combinations of the conventional left and right channels, the center channel, the left and right surround sound channels and the low frequency effects (LFE or "subwoofer") channel, to create a desired atmosphere. Moreover, the end-user may also select the number and type of speakers used in the system. The selection of speakers however has a direct impact on the ability to realize the characteristics of the various channels. While some speakers can effectively handle only low frequency (bass) signals, others can only handle high frequency signals without producing distortion or noise and/or becoming damaged themselves. Moreover, some speakers having a broadband frequency response and can handle low and high frequencies.

At least two standards have been established which set out effective ways of using multichannel audio with various speaker configurations. One standard has been promulgated by Dolby Laboratories for the processing of Dolby AC-3 and ProLogic® compressed audio. In each case, various speaker configurations are defined along the attenuation, filtering and crossovers necessary not only to protect the speakers from stress caused by out-of-band signals, but also to insure that the available speakers in the configuration are used to their best advantage. For reference, the Dolby® configuration is described in Table 3.

TABLE 3

| Configuration | Left and Right Channels (LR) | Center Channel (C) | Left and Right Surround (S) | Subwoofer (SUB) | Bass |
|---|---|---|---|---|---|
| Dolby 0 | FULL RANGE | FULL RANGE | FULL RANGE | Yes | LFE + 10 dB, LR, S, C to SUB |
| Dolby 1 | HPF | HPF | HPF | Yes or No | LFE + 10 dB, LR, C, S summed to SUB |
| Dolby 2 | FULL RANGE | HPF | HPF | No | LFE + 5.5 dB, C-4.5 dB, S to LR |
| Dolby 3 | FULL RANGE | FULL RANGE | FULL RANGE | Yes | LFE + 10 dB to SUB |
| Dolby 3 | FULL RANGE | FULL RANGE | FULL RANGE | No | LFE to LR, S |
| Dolby 3 | FULL RANGE | HPF | FULL RANGE | Yes | LFE + 10 dB to SUB, C to LR |
| Dolby 3 | FULL RANGE | HPF | FULL RANGE | No | C to LR - 4.5 dB, LFE to LR, LS, RS |

In Table 1, the speaker setups are defined in terms of their corresponding Dolby configuration number. When the term HPF (high pass filter) is used, the associated speaker is a small or high frequency speaker requiring that the low frequency components be filtered out. The Bass column defines the various summations of signals used to create the bass effect. For example, LFE+10 dB, LR, C, S to SUB signifies that the low frequency effects (LFE), left and right (L,R), center (C) and surround (S) channel data are summed together to drive the subwoofer or other capable speaker or speakers, with the LFE channel amplified by 10 dB with respect to the other channels.

In the past, multichannel audio signals were filtered and routed to the appropriate speakers using individual hardware paths. As a result, a system either required an entire circuit board capable of handling a number of speaker configurations or was limited in number of speaker configurations with which it could operate. The principles of the present invention however avoid these problems by providing a software solution which allow single-chip audio decoder 100 to support, at a minimum, all of the Dolby standard configurations, and additionally many other configurations.

Figure 5A:
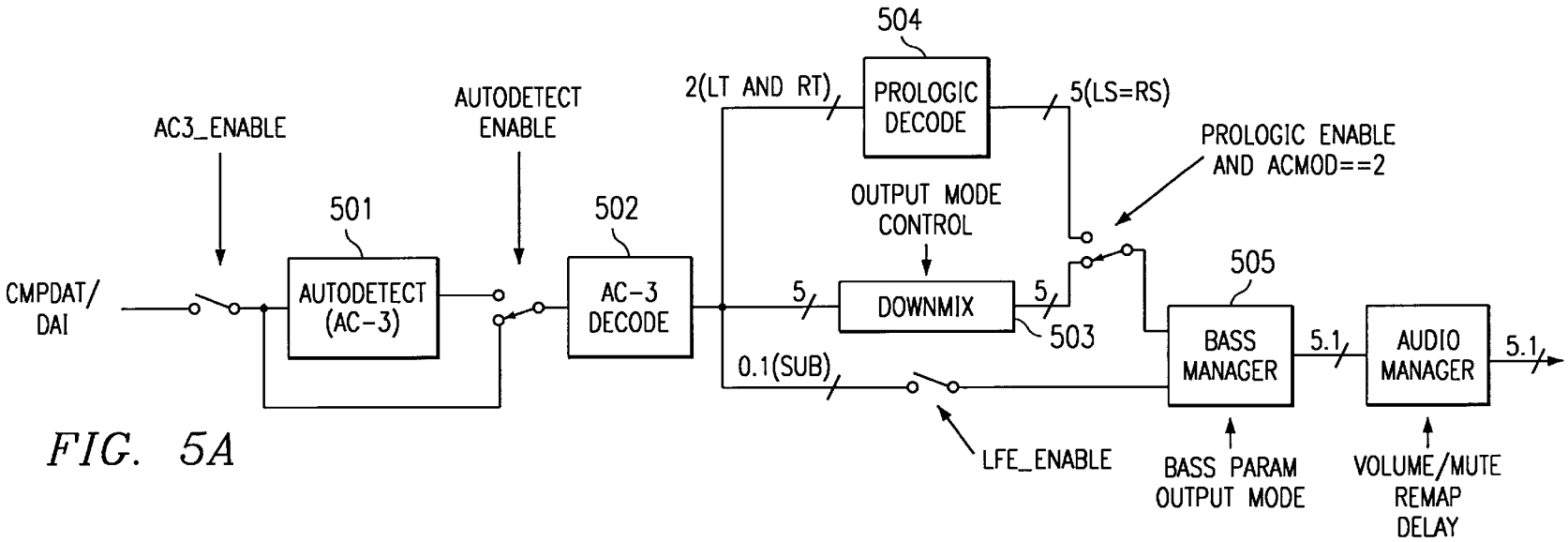
FIG. 5A is a diagram of the processing path taken when AC3 data is being decoded by the decoder.

FIG. 5A is a diagram generally depicting the processing path taken when AC3 encoded data are being processed. In this case, the incoming data are optionally passed through an Autodetect Module 501 which automatically detects the presence of AC3 encoded data if the characteristics of the incoming data are otherwise unknown. Such a method of autodetection is described in co-pending and co-assigned U.S. Pat. application Ser. No. 09/042,288, entitled "INPUT DATA FORMAT AUTODETECTION SYSTEMS AND METHODS", filed Mar. 13, 1998.

When AC3 data is being processed, AC3 decoding, takes place at module 502. The decoded data is passed to Downmix Module 503 and then on to Bass Manager 504 discussed in detail below. The downmix Module is used to control the output mode through channel mixing, to redirect audio from channels with nonexistent speakers to other, existent speakers via suitable mixing. Alternatively, the incoming data stream may be encoded by the Dolby Laboratories ProLogic protocol, in which case it is decoded by module 504. After ProLogic decode, the decoded data is sent directly to Bass Manager 505.

Figure 5B:
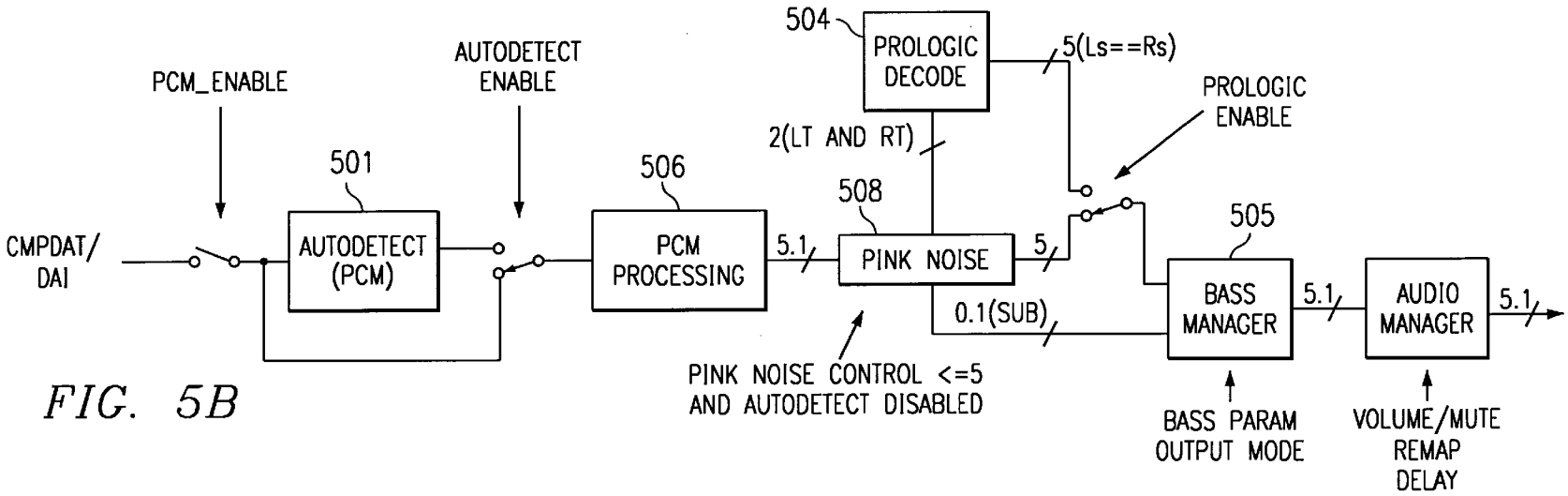
FIG. 5B is a diagram of the processing path taken when PCM data is being decoded by the decoder.

A similar path is taken for PCM data, as shown in FIG. 5B. Autodetect Module 501 can again be used, although in this case PCM data is being detected. PCM decoding under the AC3 standard is performed in PCM Decoder Module 506. Pink noise is available for calibrating the levels of each channel via listening tests.

Figure 6:
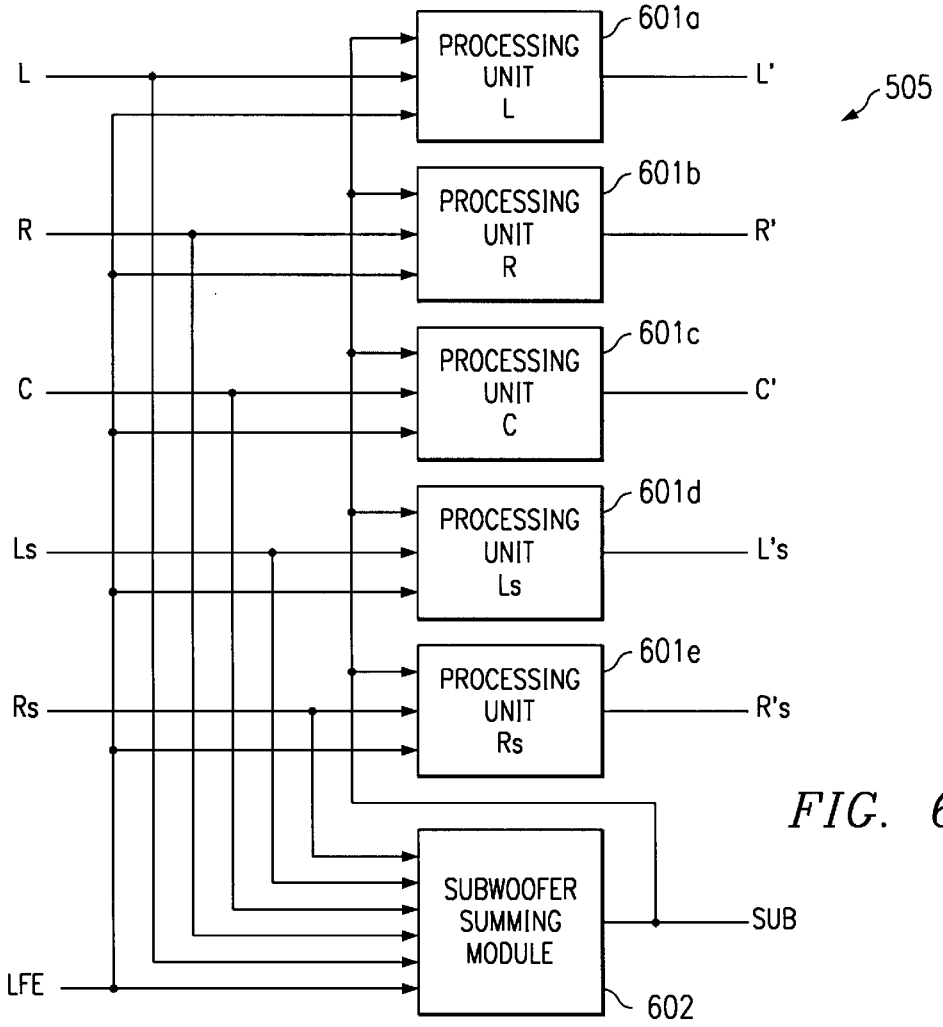
FIG. 6 is a diagram of the primary blocks of the Bass Manager shown in FIGS. 5A and 5B.

A diagram of the high-level blocks of Bass Manager 504 is shown as FIG. 6. For each of the left (L), right (R), center (C), left surround (Ls) and right surround (Rs) (collectively, "S" or "surround") channels, an independent Processing Unit 601 is provided in software. These units are described in further reference to FIGS. 7A and 7B, where X is a dummy variable in the block and control signal names representing a given channel. The low frequency effects (LFE) channel is also presented to each Processing Unit 601 as well as to Subwoofer Summing Module 602. This module is further described in FIG. 8.

Each processing unit 601 includes an Input Level module 701 (FIG. 7A) for setting the input level of the corresponding channel into the Bass Manager 505 as determined by the Input_X_Level bits. Possible input level settings, along with those for the other modules being discussed here, will be discussed further with respect to exemplary system configurations.

From Input Level Module 701, the channel being processed can take either of two paths. In one path, the channel is passed through a high pass filter 702 and switch 703 to the bass manager output (OUTPUT CHANNELX) when the HPF_X_Enable bit is set active. The high pass filter is used, when the given channel is driving a small (high frequency) speaker which cannot handle low frequency signals without distortion or damage.

In the other path, the channel is combined at summer module 705 with the level adjusted output of summing module 602 and/or the level adjusted direct input of LFE. Level adjustments are made by Level Adjustment Module 706, under control of the Sum_Output_X_Level bits, and Level Adjustment Module 707, under control of LFE_X_Level bits, respectively. This allows bass and low frequency effects signals being processed by the given Unit 601.

Figure 7A:
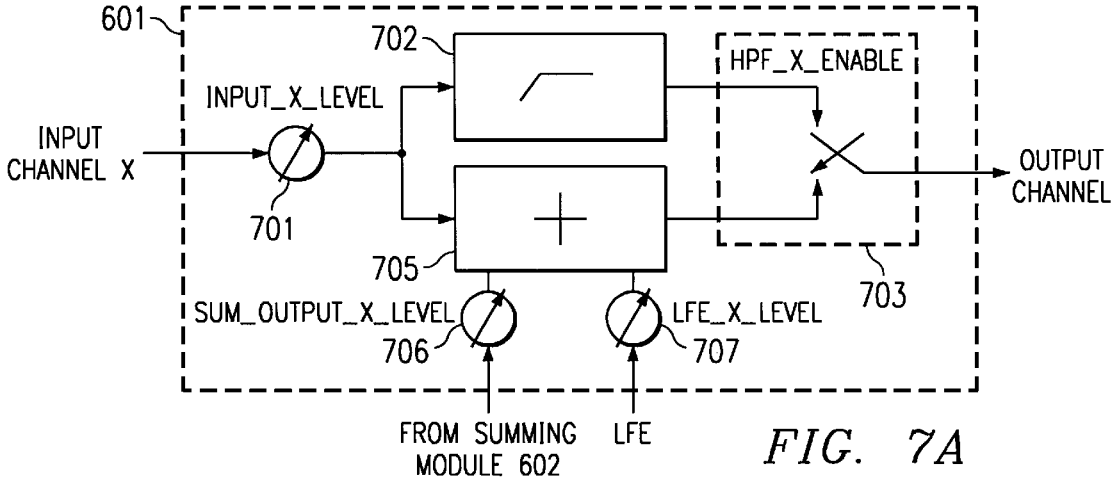
FIG. 7A is a diagram of an exemplary Processing Unit shown in FIG. 6.
Figure 7B:
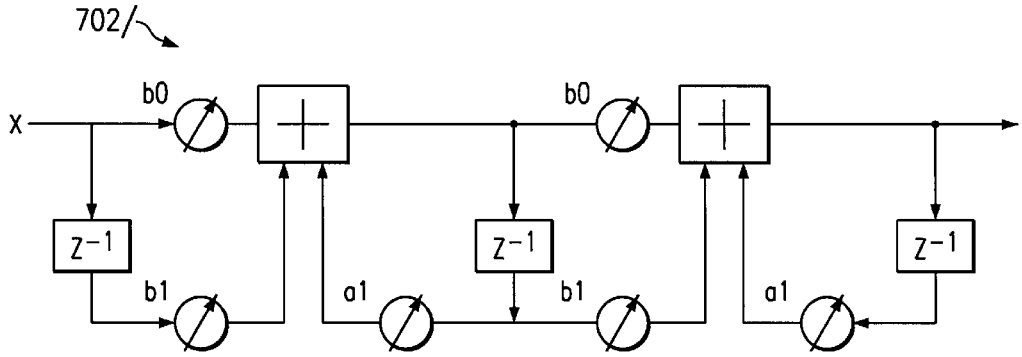
FIG. 7B is a block diagram of an exemplary filter topology for use in the high-pass and low-pass filters of the Bass Manager of FIG. 6.
Figure 8:
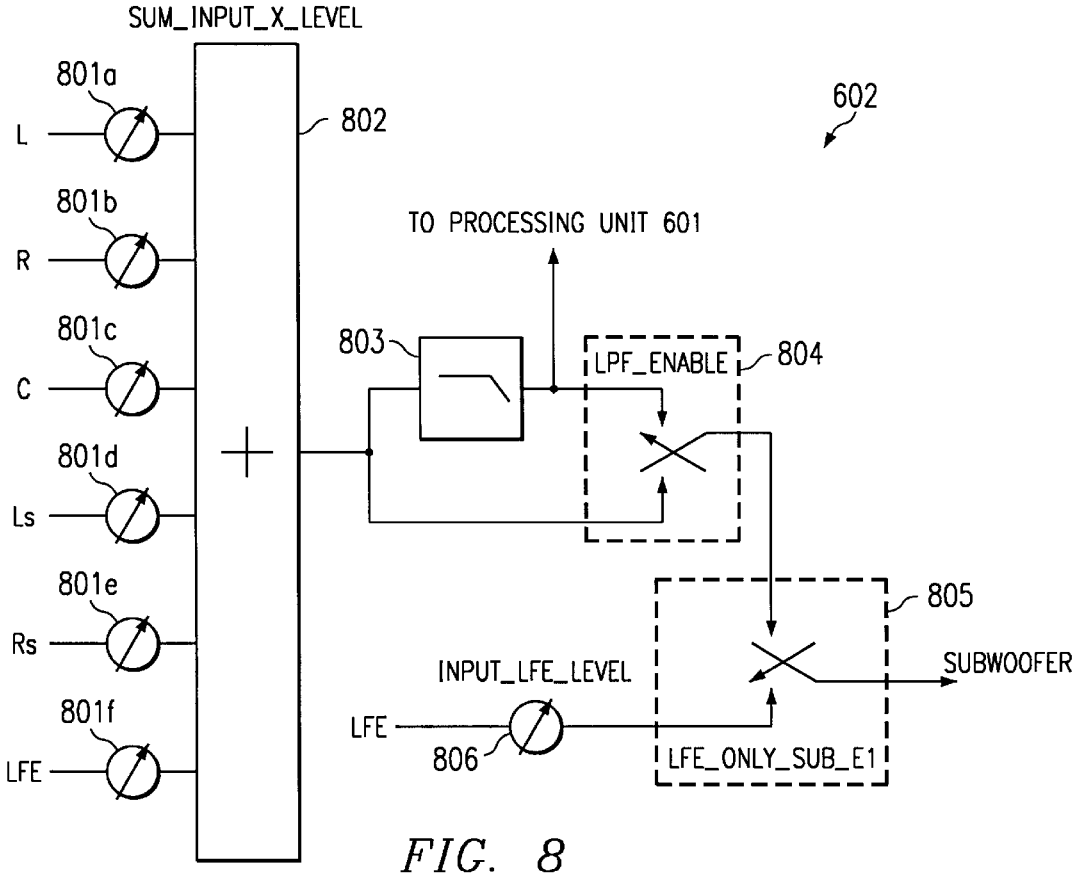
FIG. 8 is a block diagram of the Subwoofer Summing Module of FIG. 6.

FIG. 7B depicts the topology of an Infinite Impulse Response (IIR) filter preferably used to implement both high pass filter 702 and low pass filter 803 discussed below. Generally, this filter topology consists of two (or more) first or second order filters cascaded to implement a second (or higher) order filter. The filter coefficients a1, b0 and b1 (and a2, b2 for second order) are advantageously set by software which allows the corner frequency to be changed easily.

Subwoofer Summing Module 602 has four possible paths for driving a subwoofer or other low frequency capable speaker. In the first path, all channels, after selective level adjustment by Level Adjustment Modules 801, are summed together by Summing Module 802. The level adjustment is effectuated by control bits Sum_Input_X_Level. The assertion of Sum_Input_X_Level==0 effectively disregards the channel x in the summation. The combined output can then selectively be passed through a low pass filter 803 and on to the output through switches 804 and 805 under the control of bits LPF_Enable and LFE__Only__Sub__Enable. In a second mode, filter 803 can be bypassed and the output from Summing Module 802 used to directly drive the subwoofer. This selection is made using the LFE__Enable bit and switch 804. The output of filter 803 is also fed to processing units 601. As discussed above, this signal is level shifted and summed with the signal from the given channel, when desired. This path is used to mix the bass redirected away from small speakers (that cannot handle bass) into large speakers (non-subwoofer) that can handle extra bass.

In the third mode, the summed output from low pass filter 603 is sent to processing node 601 (i.e., to the input of level adjuster 706 discussed below).

The fourth way in which the subwoofer can be driven is by the LFE channel directly. This alternative is selected using the LFE__Only__Sub__Enable bit. A level adjustment can be made in this case to the LFE channel using Input__LFE__Level and level adjust module 806.

Module enablement and bit settings for exemplary Dolby Configurations are provided in Tables 4–11. Similar settings can be used for user custom configurations. High and low pass filter, LFE only to subwoofer, and bass manger post-processing enable is performed by 8 Bass__Mgr__Control bits. Each level control function is set up using 24-bit words.

For discussion purposes, assume that a Dolby Configuration 1 speaker configuration is being used as described in Table 4. In this case, the left and right, center and surround speakers are all high frequency (small) and a subwoofer, when used, is driven by the LFE channel +10 dB +crossover from the left and right (LR) channels, the center (C) channel and the surround (S) channels.

The bit selection for this configuration is given in Table 4. For the Dolby Configuration 1, Bass Manager 505 is enabled with the following paths enabled or disabled. The direct LFE path to the output through summing module switch 805 is disabled and the path through Summing Module 802 and Low Pass Filter 803 enabled. Processing Unit Input Level Modules 701 are all set to 0 dB and the summed inputs from the Summing Module turned-off (i.e level module 706 set to a negative infinite gain). Similarly, the direct LFE inputs to the Processing Modules are turned-off by level modules 707.

In cases, such as Dolby Configuration 1, a gain (e.g. +10 dB) is not directly applied to the LFE channel to drive the subwoofer. Instead, the inputs to summer 802 are attenuated to achieve the same result. In this example, the L,R,C,Ls, and Rs channels are all attenuated by −15 dB and the LFE channel attenuated by −5 dB. This implements the LFE +10 dB channel specified for Dolby Configuration 1. However, a compensating 15 dB gain should be applied later, usually in analog after the DACs.

In summary, since bass management is now software controlled, the amount of necessary hardware is minimized. Hence, this function can be fully implemented by a single chip audio processing device instead of an entire circuit board. Advantageously, the number of possible configurations supported extends beyond those specified by Dolby. Through programming, the end user can support customized configurations using the several degrees of freedom allowed by the present inventive concepts. This includes the ability to select signal levels, load filter coefficients to adjust the corners in the response of the low and high pass filters, and crossover and/or sum signals to drive a given speaker, as appropriate.

Although the invention has been described with reference to a specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore, contemplated that the claims will cover any such modifications or embodiments that fall within the true scope of the invention.

TABLE 4

| Dolby Configuration 0 | |
|---|---|
| Bass__Mgr__Control | LFE__Only__Sub DISABLED |
| | LPF DISABLED |
| | HPF__L DISABLED |
| | HPF__C DISABLED |
| | HPF__R DISABLED |
| | HPF__Ls DISABLED |
| | HPF__Rs DISABLED |
| | Bass__Mgr ENABLED |
| Input__L__Level | 0 dB |
| Input__C__Level | 0 dB |
| Input__R__Level | 0 dB |
| Input__Ls__Level | 0 dB |
| Input__Rs__Level | 0 dB |
| Input__LFE__Level | 0 dB |
| Sum__Output__L__Level | −∞ dB |
| Sum__Output__C__Level | −∞ dB |
| Sum__Output__R__Level | −∞ dB |
| Sum__Output__Ls__Level | −∞ dB |
| Sum__Output__Rs__Level | −∞ dB |
| LFE__L__Level | −∞ dB |
| LFE__C__Level | −∞ dB |
| LFE__R__Level | −∞ dB |
| LFE__Ls__Level | −∞ dB |
| LFE__Rs__Level | −∞ dB |
| Sum__Input__L__Level | −15 dB |
| Sum__Input__C__Level | −15 dB |
| Sum__Input__R__Level | −15 dB |
| Sum__Input__Ls__Level | −15 dB |
| Sum__Input__Rs__Level | −15 dB |
| Sum__Input__LFE__Level | −5 dB |

TABLE 5

| Dolby Configuration 1 | |
|---|---|
| Bass__Mgr__Control | LFE__Only__Sub DISABLED |
| | LPF ENABLED |
| | HPF__L ENABLED |
| | HPF__C ENABLED |
| | HPF__R ENABLED |
| | HPF__Ls ENABLED |
| | HPF__Rs ENABLED |
| | Bass__Mgr ENABLED |
| Input__L__Level | 0 dB |
| Input__C__Level | 0 dB |
| Input__R__Level | 0 dB |
| Input__Ls__Level | 0 dB |
| Input__Rs__Level | 0 dB |
| Input__LFE__Level | 0 dB |
| Sum__Output__L__Level | −∞ dB |
| Sum__Output__C__Level | −∞ dB |
| Sum__Output__R__Level | −∞ dB |
| Sum__Output__Ls__Level | −∞ dB |
| Sum__Output__Rs__Level | −∞ dB |
| LFE__L__Level | −∞ dB |
| LFE__C__Level | −∞ dB |

TABLE 5-continued

| Dolby Configuration 1 | |
|---|---|
| LFE_R_Level | −∞ dB |
| LFE_Ls_Level | −∞ dB |
| LFE_Rs_Level | −∞ dB |
| Sum_Input_L_Level | −15 dB |
| Sum_Input_C_Level | −15 dB |
| Sum_Input_R_Level | −15 dB |
| Sum_Input_Ls_Level | −15 dB |
| Sum_Input_Rs_Level | −15 dB |
| Sum_Input_LFE_Level | −5 |

TABLE 6

| Dolby Configuration 2 | |
|---|---|
| Bass_Mgr_Control | LFE_Only_Sub DISABLED<br>LPF ENABLED<br>HPF_L DISABLED<br>HPF_C ENABLED<br>HPF_R DISABLED<br>HPF_Ls ENABLED<br>HPF_Rs ENABLED<br>Bass_Mgr ENABLED |
| Input_L_Level | −12 dB |
| Input_C_Level | ADJ, default = 0 dB |
| Input_R_Level | −12 dB |
| Input_Ls_Level | ADJ, Default = 0 dB |
| Input_Rs_Level | ADJ, Default = 0 dB |
| Input_LFE_Level | 0 dB |
| Sum_Output_L_Level | −1.5 dB |
| Sum_Output_C_Level | − ∞ dB |
| Sum_Output_R_Level | −1.5 dB |
| Sum_Output_Ls_Level | −∞ dB |
| Sum_Output_Rs_Level | −∞ dB |
| LFE_L_Level | −∞ dB |
| LFE_C_Level | −∞ dB |
| LFE_R_Level | −∞ dB |
| LFE_Ls_Level | −∞ dB |
| LFE_Rs_Level | −∞ dB |
| Sum_Input_L_Level | −∞ dB |
| Sum_Input_C_Level | −15 dB |
| Sum_Input_R_Level | −∞ dB |
| Sum_Input_Ls_Level | −15 dB |
| Sum_Input_Rs_Level | −15 dB |
| Sum_Input_LFE_Level | −5 dB |

TABLE 7

| Dolby Alternative Configuration 2 | |
|---|---|
| Bass_Mgr_Control | LFE_Only_Sub DISABLED<br>LPF ENABLED<br>HPF_L DISABLED<br>HPF_C ENABLED<br>HPF_R DISABLED<br>HPF_Ls ENABLED<br>HPF_Rs ENABLED<br>Bass_Mgr ENABLED |
| Input_L_Level | 0 dB |
| Input_C_Level | 0 dB |
| Input_R_Level | 0 dB |
| Input_Ls_Level | 0 dB |
| Input_Rs_Level | 0 dB |
| Input_LFE_Level | 0 dB |
| Sum_Output_L_Level | −∞ dB |
| Sum_Output_C_Level | −∞ dB |
| Sum_Output_R_Level | −∞ dB |
| Sum_Output_Ls_Level | −∞ dB |
| Sum_Output_Rs_Level | −∞ dB |
| LFE_L_Level | −∞ dB |
| LFE_C_Level | −∞ dB |
| LFE_R_Level | −∞ dB |
| LFE_Ls_Level | −∞ dB |

TABLE 7-continued

| Dolby Alternative Configuration 2 | |
|---|---|
| LFE_Rs_Level | −∞ dB |
| Sum_Input_L_Level | −∞ dB |
| Sum_Input_C_Level | −15 dB |
| Sum_Input_R_Level | −∞ dB |
| Sum_Input_Ls_Level | −15 dB |
| Sum_Input_Rs_Level | −15 dB |
| Sum_Input_LFE_Level | −5 dB |

TABLE 8

| Dolby Configuration 3 (No Sub Out) | |
|---|---|
| Bass_Mgr_Control | LFE_Only_Sub DISABLED<br>LPF ENABLED<br>HPF_L DISABLED<br>HPF_C ENABLED<br>HPF_R DISABLED<br>HPF_Ls DISABLED<br>HPF_Rs DISABLED<br>Bass_Mgr ENABLED |
| Input_L_Level | −8 dB |
| Input_C_Level | −8 dB |
| Input_R_Level | −8 dB |
| Input_Ls_Level | −8 dB |
| Input_Rs_Level | −8 dB |
| Input_LFE_Level | −8 dB |
| Sum_Output_L_Level | −4.5 dB |
| Sum_Output_C_Level | −∞ dB |
| Sum_Output_R_Level | −4.5 dB |
| Sum_Output_Ls_Level | −∞ dB |
| Sum_Output_Rs_Level | −∞ dB |
| LFE_L_Level | 0 dB |
| LFE_C_Level | −∞ dB |
| LFE_R_Level | 0 dB |
| LFE_Ls_Level | 0 dB |
| LFE_Rs_Level | 0 dB |
| Sum_Input_L_Level | −∞ dB |
| Sum_Input_C_Level | −8 dB |
| Sum_Input_R_Level | −∞ dB |
| Sum_Input_Ls_Level | −∞ dB |
| Sum_Input_Rs_Level | −∞ dB |
| Sum_Input_LFE_Level | −∞ dB |

TABLE 9

| Dolby Configuration 3 (Sub Out) | |
|---|---|
| Bass_Mgr_Control | LFE_Only_Sub ENABLED<br>LPF ENABLED<br>HPF_L DISABLED<br>HPF_C ENABLED<br>HPF_R DISABLED<br>HPF_Ls DISABLED<br>HPF_Rs DISABLED<br>Bass_Mgr ENABLED |
| Input_L_Level | −4 dB |
| Input_C_Level | −4 dB |
| Input_R_Level | −4 dB |
| Input_Ls_Level | −4 dB |
| Input_Rs_Level | −4 dB |
| Input_LFE_Level | −4 dB |
| Sum_Output_L_Level | −4.5 dB |
| Sum_Output_C_Level | −∞ dB |
| Sum_Output_R_Level | −4.5 dB |
| Sum_Output_Ls_Level | −∞ dB |
| Sum_Output_Rs_Level | −∞ dB |
| LFE_L_Level | −∞ dB |
| LFE_C_Level | −∞ dB |
| LFE_Ls_Level | −∞ dB |
| LFE_Rs_Level | −∞ dB |
| Sum_Input_L_Level | −∞ dB |
| Sum_Input_C_Level | −4 dB |

TABLE 9-continued

| Dolby Configuration 3 (Sub Out) | |
|---|---|
| Sum_Input_R_Level | −∞ dB |
| Sum_Input_Ls_Level | −∞ dB |
| Sum_Input_Rs_Level | −∞ dB |
| Sum_Input_LFE_Level | −∞ dB |

TABLE 10

| Dolby DVD Configuration (Bass to L/R) | |
|---|---|
| Bass_Mgr_Control | LFE_Only_Sub ENABLED<br>LPF ENABLED<br>HPF_L DISABLED<br>HPF_C ENABLED<br>HPF_R DISABLED<br>HPF_Ls ENABLED<br>HPF_Rs ENABLED<br>Bass_Mgr ENABLED |
| Input_L_Level | 0 dB |
| Input_C_Level | 0 dB |
| Input_R_Level | 0 dB |
| Input_Ls_Level | 0 dB |
| Input_Rs_Level | 0 dB |
| Input_LFE_Level | −5 dB |
| Sum_Output_L_Level | 0 dB |
| Sum_Output_C_Level | −∞ dB |
| Sum_Output_R_Level | 0 dB |
| Sum_Output_Ls_Level | −∞ dB |
| Sum_Output_Rs_Level | −∞ dB |
| LFE_L_Level | −∞ dB |
| LFE_C_Level | −∞ dB |
| LFE_R_Level | −∞ dB |
| LFE_Ls_Level | −∞ dB |
| LFE_Rs_Level | −∞ dB |
| Sum_Input_L_Level | −∞ dB |
| Sum_Input_C_Level | −4.5 dB |
| Sum_Input_R_Level | −∞ dB |
| Sum_Input_Ls_Level | −4.5 dB |
| Sum_Input_Rs_Level | −4.5 dB |
| Sum_Input_LFE_Level | 0 dB |

TABLE 11

| Dolby DVD Configuration (Bass to Subwoofer) | |
|---|---|
| Bass_Mgr_Control | LFE_Only_Sub DISABLED<br>LPF ENABLED<br>HPF_L DISABLED<br>HPF_C ENABLED<br>HPF_R DISABLED<br>HPF_Ls ENABLED<br>HPF_Rs ENABLED<br>Bass_Mgr ENABLED |
| Input_L_Level | 0 dB |
| Input_C_Leve1 | 0 dB |
| Input_R_Level | 0 dB |
| Input_Ls_Level | 0 dB |
| Input_Rs_Level | 0 dB |
| Input_LFE_Level | 0 dB |
| Sum_Output_L_Level | −∞ dB |
| Sum_Output_C_Level | −∞ dB |
| Sum_Output_R_Level | −∞ dB |
| Sum_Output_Ls_Level | −∞ dB |
| Sum_Output_Rs_Level | −∞ dB |
| LFE_L_Level | −∞ dB |
| LFE_C_Level | −∞ dB |
| LFE_R_Level | −∞ dB |
| LFE_Ls_Level | −∞ dB |
| LFE_Rs_Level | −∞ dB |
| Sum_Input_L_Level | −∞ dB |
| Sum_Input_C_Level | −15 dB |
| Sum_Input_R_Level | −∞ dB |
| Sum_Input_Ls_Level | −15 dB |

TABLE 11-continued

| Dolby DVD Configuration (Bass to Subwoofer) | |
|---|---|
| Sum_Input_Rs_Level | −15 dB |
| Sum_Input_LFE_Level | −5 dB |

What is claimed is:

1. A method of managing multiple channels of audio data in an audio system including a processing engine operating in response to software routines and having multiple speakers comprising the steps of:

selectively passing a first channel signal through a software high pass filter to selectively drive a first one of the speakers;

selectively summing in software a plurality of channel signals to generate a composite signal; and selectively passing the composite signal through a software low pass filter to selectively drive a second one of the speakers.

2. The method of claim 1 wherein said step of selectively passing a first channel signal through a high pass filter comprises the substeps of:

in a first mode, passing the first channel signal through the high pass filter for driving the first speaker; and in a second mode, summing the first channel signal with a second signal for driving the first speaker.

3. The method of claim 2 further comprising the step of selectively passing a second channel signal to said second one of the speakers and blocking said composite signal.

4. The method of claim 1 wherein said step of selectively passing the composite signal through a low pass filter comprises the substeps of:

in a first mode, passing the composite signal through the low pass filter for driving the second speaker;

in a second mode, passing the unfiltered composite signal for driving the second speaker; and in a third mode, blocking said composite signal passing a selected channel signal for driving the second speaker.

5. The method of claim 1, where the composite signal is identical to a selected one of the multiplicity of audio channels.

6. The method of claim 1 wherein the second speaker comprises a low frequency speaker.

7. The method of claim 1 wherein the first speaker comprises a high frequency speaker.

8. The method of claim 1 wherein the first speaker comprises a broadband speaker.

9. A digital signal processing program for speaker management in an audio system comprising:

a processing unit for selectively driving a first speaker from a first input data stream corresponding to a first channel comprising:

a first processing path including a filter for filtering the input stream; and a second processing path including a summer for combining the first input stream with a second data stream; and a routine for passing to the first speaker a data stream generated by a selected one of the first and second paths of the processing unit; and a summing module for selectively driving a second speaker comprising:

a first processing path including a summer for combining a plurality of received data streams each corresponding to a channel and a filter for selectively filtering the combination of the plurality of data streams;

a second processing path for passing a second input data stream corresponding to a second channel; and a routine for passing to the second speaker a data stream generated by a selected one of the first and second paths of the summing module.

10. The program of claim 9 wherein the second stream of data combined by the second processing path of the processing unit comprises an output of the filter of the first path of the summing module.

11. The program of claim 9 and further comprising a processing path for selectively passing a data stream from a said first processing path of said summing module to said second path of said processing unit.

12. The program of claim 9 wherein the filter of the first processing path of the processing unit comprises a high pass filter and the filter of the first processing path of the summing module comprises a low pass filter.

13. The program of claim 12 wherein the filters comprise infinite impulse response filters with programmable coefficients.

14. The program of claim 13 wherein the filters comprise a cascade of the first order infinite impulse response filters.

15. The program of claim 12 wherein said filters comprise a cascade of first order infinite impulse response filters.

16. The program of claim 9 wherein the first input data stream is selected from the group consisting of left, right, center and surround channel data streams.

17. The program of claim 9 wherein the plurality of data streams are each selected from the group consisting of left, right, center, surround and low frequency effects channel data streams.

18. A multi-speaker audio system comprising:

a single-chip processing device operating in response to a program for managing multiple channels of audio data and operable to:

pass data of a selected channel through a high pass filter when selectively driving a high frequency speaker;

sum data of a plurality of channels when selectively driving a full bandwidth speaker; and provide low frequency data when selectively driving a low frequency speaker.

19. The audio system of claim 18 wherein said processing device is operable to provide said low frequency data by passing received low frequency data to said low frequency speaker.

20. The audio system of claim 18 wherein said processing device is operable to provide said low frequency data by providing a sum of data of a plurality of channels to said low frequency speaker.

21. The audio system of claim 18 wherein said processing device comprises a digital signal processor.

22. The audio system of claim 18 wherein said processing device comprises an audio decoder.

23. The audio system of claim 22 wherein said processing device comprises a dual digital signal processor audio decoder.

* * * * *